US010141669B2

(12) United States Patent
Tyler et al.

(10) Patent No.: US 10,141,669 B2
(45) Date of Patent: Nov. 27, 2018

(54) PLUG CONNECTOR HAVING A TAB TERMINAL FOR A POWER CONNECTOR SYSTEM

(71) Applicant: TE CONNECTIVITY CORPORATION, Berwyn, PA (US)

(72) Inventors: Adam Price Tyler, Rochester Hills, MI (US); David James Rhein, Memphis, MI (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/661,823

(22) Filed: Jul. 27, 2017

(65) Prior Publication Data

US 2018/0034178 A1 Feb. 1, 2018

Related U.S. Application Data

(60) Provisional application No. 62/369,442, filed on Aug. 1, 2016.

(51) Int. Cl.

| | |
|---|---|
| ***H01R 13/04*** | (2006.01) |
| ***H01R 13/629*** | (2006.01) |
| ***H01R 13/11*** | (2006.01) |
| ***H01R 13/193*** | (2006.01) |
| *H01R 24/20* | (2011.01) |

(Continued)

(52) U.S. Cl.

CPC ..... *H01R 13/04* (2013.01); *H01R 13/113* (2013.01); *H01R 13/193* (2013.01); *H01R 13/62977* (2013.01); *H01R 13/112* (2013.01); *H01R 13/26* (2013.01); *H01R 24/20* (2013.01); *H01R 24/28* (2013.01); *H01R 2103/00* (2013.01); *H01R 2201/26* (2013.01)

(58) Field of Classification Search

CPC ..... H01R 13/03; H01R 12/79; H01R 13/113; H01R 13/6587; H01R 2107/00; H01R 24/58; H01R 13/187; H01R 13/193; H01R 43/16; H01R 12/712; H01R 12/737; H01R 13/639; H01R 2201/12; H01R 13/05

See application file for complete search history.

(56) References Cited

U.S. PATENT DOCUMENTS 5,556,285 A * 9/1996 Ono ..... H01R 13/113 439/74
6,171,155 B1 * 1/2001 Miwa ..... H01R 13/187 439/845

(Continued)

FOREIGN PATENT DOCUMENTS

EP 2426788 A1 3/2012
WO 2009064563 A1 5/2009

OTHER PUBLICATIONS

International Search Report, International Application No. PCT/IB2017/054627, International Filing Date Jul. 28, 2017.

*Primary Examiner* — Truc T Nguyen

(57) ABSTRACT

A plug connector includes a housing having a mating end and a cable end. The mating end is configured to be mated with a header connector in a mating direction. A tab terminal is held in the housing at the mating end. The tab terminal has a leading edge configured to be mated with the header terminal of the header connector when the plug connector is mated to the header connector. The leading edge is tapered such that the tab terminal sequentially mates with the header terminal during mating.

20 Claims, 7 Drawing Sheets

(51) Int. Cl.

| | |
|---|---|
| *H01R 24/28* | (2011.01) |
| *H01R 103/00* | (2006.01) |
| *H01R 13/26* | (2006.01) |

(56) References Cited

U.S. PATENT DOCUMENTS

| | | | | |
|---|---|---|---|---|
| 2005/0037653 | A1* | 2/2005 | Comerci | H01R 23/661 439/329 |
| 2014/0227913 | A1* | 8/2014 | Natter | H01R 13/42 439/725 |
| 2014/0227915 | A1* | 8/2014 | Glick | H01R 13/113 439/856 |

* cited by examiner

PLUG CONNECTOR HAVING A TAB TERMINAL FOR A POWER CONNECTOR SYSTEM

CROSS-REFERENCE TO RELATED APPLICATIONS

This application claims priority to U.S. Provisional Application No. 62/369,442, filed 1 Aug. 2016, titled "PLUG CONNECTOR HAVING A TAB TERMINAL FOR A POWER CONNECTOR SYSTEM", which is incorporated by reference herein in its entirety.

BACKGROUND OF THE INVENTION

The subject matter herein relates generally to plug connectors for power connector systems.

Power terminals are used to make a power connection between components in high power applications, such as in electric or hybrid electric vehicles between the battery and other components, such as the electric motor, the inverter, the charger, and the like. However, due to the high power requirements, the electrical connectors typically house many contacts to increase the current capacity of the circuits. Having many contact points leads to high connector mating forces. Furthermore, the power terminals, particularly in automotive applications, are subjected to vibration and wear over time. The spring beams making the electrical connection between the power terminals may degrade over time reducing stability of the system. Using higher normal force spring beams to compensate for such stability problems leads to high connector mating forces.

A need remains for a power connector system having reduced connector mating forces without sacrificing the number of contact points or contact normal force.

BRIEF DESCRIPTION OF THE INVENTION

In one embodiment, a plug connector is provided including a housing having a mating end and a cable end. The mating end is configured to be mated with a header connector in a mating direction. A tab terminal is held in the housing at the mating end. The tab terminal has a leading edge configured to be mated with a header terminal of the header connector when the plug connector is mated to the header connector. The leading edge is tapered such that the tab terminal sequentially mates with the header terminal during mating.

In another embodiment, a power connector system is provided including a header connector having a header housing holding a plurality of contact members. Each contact member has a fork contact at a mating end thereof. Each fork contact has a pair of spring beams defining a socket. The contact members are arranged side-by-side in a stacked arrangement to define a header terminal such that the sockets of the contact members are aligned to define a tab socket of the header terminal. The power connector system includes a plug connector having a plug housing holding a tab terminal. The plug housing has a mating end and a cable end with a power cable extending from the cable end. The mating end is mated with the header connector in a mating direction during mating. The tab terminal has first and second sides, and also has a cable end terminated to the power cable. The tab terminal has a leading edge received within the tab socket of the header terminal and engaging the fork contacts of the contact members of the header terminal when the plug connector is mated to the header connector. The leading edge is tapered such that the tab terminal sequentially mates with the contact members during mating.

DETAILED DESCRIPTION OF THE INVENTION

Figure 1:
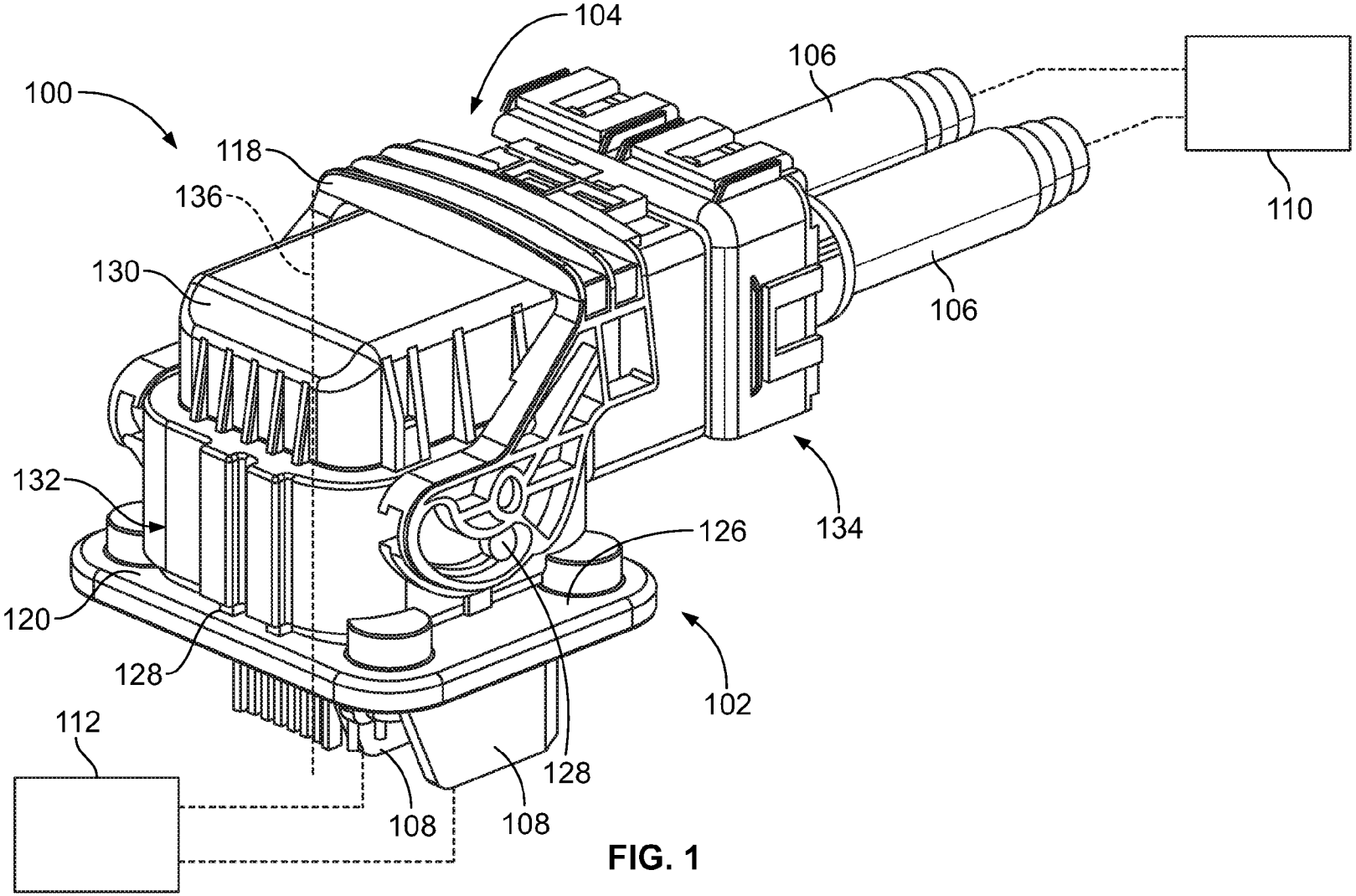
FIG. 1 is a perspective view of a power connector system formed in accordance with an exemplary embodiment showing a plug connector and a header connector in an assembled and mated state.
Figure 2:
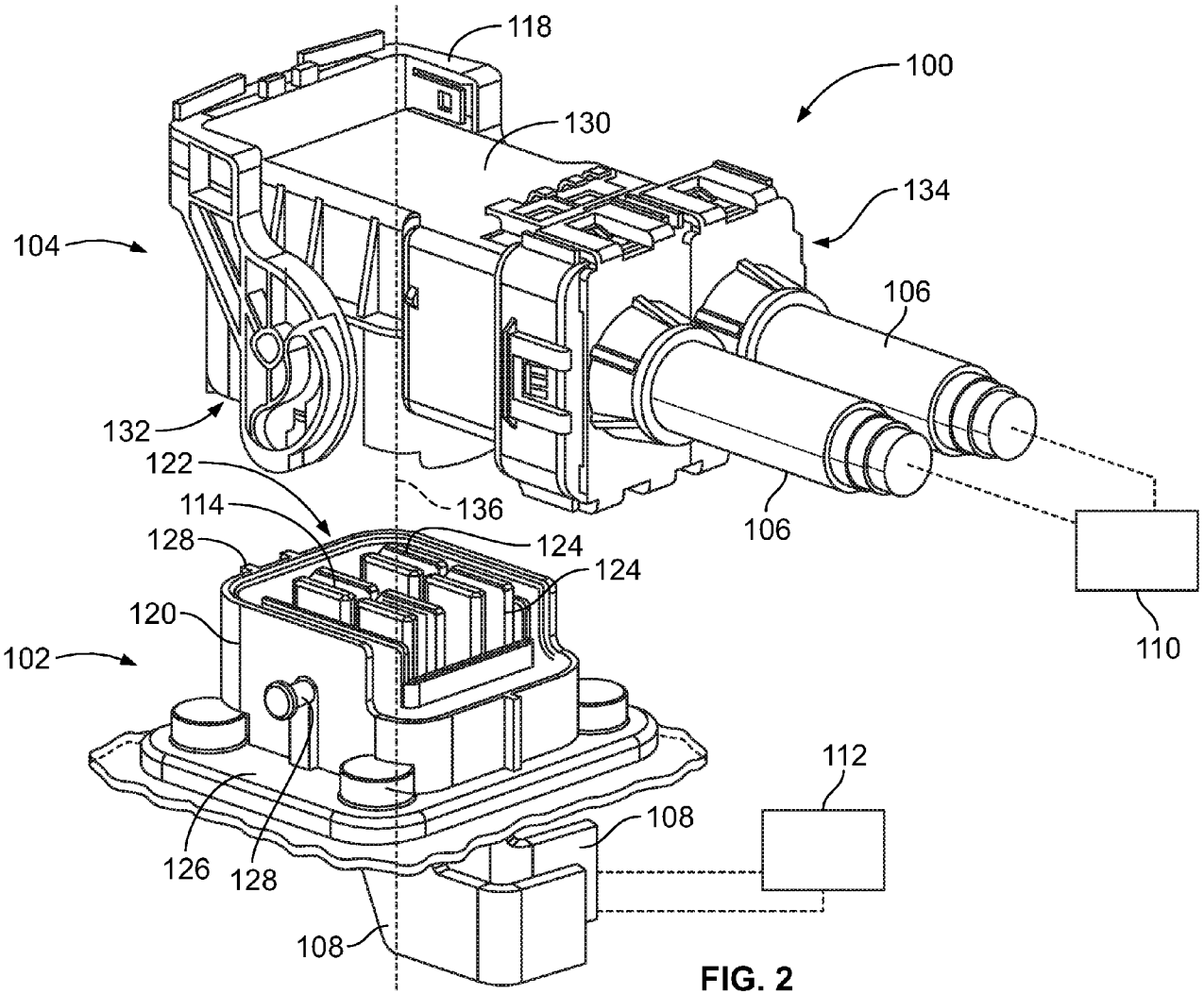
FIG. 2 is a perspective view of the power connector system showing the plug connector and the header connector in an unmated state.

FIG. 1 is a perspective view of a power connector system 100 formed in accordance with an exemplary embodiment in an assembled and mated state. FIG. 2 is a perspective view of the power connector system 100 in an unmated state. The power connector system 100 includes a header connector 102 and a plug connector 104 configured to be mated with the header connector 102. In an exemplary embodiment, the power connector system 100 is a high power connector system that is used to transfer power between various components as part of a high power circuit. In a particular application, the power connector system 100 is a battery system, such as a battery system of a vehicle, such as an electric vehicle or hybrid electric vehicle; however the power connector system 100 is not intended to be limited to such battery systems.

The plug connector 104 is configured to be electrically connected to a component 110, such as through one or more power cables 106. For example, the plug connector 104 may be electrically connected to a battery, a charger, an inverter, an electric motor or another type of component. The header connector 102 is configured to be electrically connected to a component 112, such as through a power bus 108; however, the header connector 102 may be electrically connected to the component 112 by other means, such as a terminal, power wire or other connector. For example, the header connector 102 may be electrically connected to a battery pack, such as through a battery distribution unit, a manual service disconnect, a charger, an inverter, an electric motor, or another type of component. The battery distribution unit may manage the power capacity and functionality of the power connector system 100, such as by measuring current and regulating power distribution of the battery pack.

The power connector system 100 is a right angle connector system where the connectors 102, 104 are mated in a direction perpendicular to the power wires. Optionally, the plug connector 104 may be removably coupled to the header connector 102 to disconnect the high power circuit of one or more of the components, such as the battery pack, the electric motor, the inverter, or other components of the vehicle, such as for maintenance, repair or for another reason. When mated, one or more header terminals 114 (FIG. 2) of the header connector 102 are mated with corresponding plug terminals 116 (shown in FIG. 3) of the plug connector 104, such as at mating interfaces thereof. Having a greater number of terminals 114 and/or 116 increases the current carrying capacity of the system 100. Optionally, each plug terminal 116 may be terminated to a corresponding power cable 106.

In an exemplary embodiment, the header connector 102 and/or the plug connector 104 may include a high voltage interlock (HVIL) circuit to control the high voltage power circuit during opening and closing or mating and unmating of the connectors 102, 104. For example, both connectors 102, 104 may include corresponding HVIL terminals. The HVIL circuit may be electrically connected to the component 112 and/or the component 110. In an exemplary embodiment, the plug connector 104 utilizes a lever 118 to unmate and/or mate the connectors 102, 104, which may open/close the high voltage circuit and the HVIL circuit during unmating/mating of the connectors 102, 104. The HVIL circuit may be opened first during unmating to shut of the high voltage circuit prior to opening or unmating of the terminals 116, 114, which may reduce the likelihood of damage, such as from arcing. In an exemplary embodiment, the high voltage conducting surfaces of the connectors 102, 104 are finger proof and touch safe.

The header connector 102 includes a header housing 120 having a mating end 122. The header housing 120 holds one or more of the header terminals 114. Optionally, the header terminals 114 may be fork terminals having sockets defined by spring beams on both sides of the sockets to mate with both sides of the plug terminal 116, as described in further detail below; however, other types of header terminals may be used in alternative embodiments. The header terminals 114 may be shrouded to protect the header terminals 114. For example, the header terminals 114 may have covers or touch guards 124 such that the header terminals 114 are touch safe. The header housing 120 includes a flange 126 for mounting the header housing 120 to another component, such as a chassis or other supporting structure. Optionally, the header housing 120 may be mounted horizontally; however, other orientations are possible in alternative embodiments. In an exemplary embodiment, the header housing 120 includes guide features 128 for guiding mating of the electrical connector 104 with the header connector 102. For example, the guide features 128 may be ribs, posts, slots, keying features or other types of guide features.

The plug connector 104 includes a plug housing 130 configured to be coupled to the header housing 120. The plug housing 130 includes a mating end 132 and a cable end 134. The power cables 106 extend from the cable end 134. The mating end 132 is mated to the mating end 122 of the header housing 120. In an exemplary embodiment, the housing 130 is a right angle housing holding the power cables 106 and the plug terminals 116 perpendicular to a mating direction along a mating axis 136. The power cables 106 are at a right angle with respect to the mating axis 136. Other orientations are possible in alternative embodiments.

In an exemplary embodiment, the lever 118 is rotatably coupled to the housing 130. The lever 118 is configured to engage the header housing 120, such as corresponding guide features 128, to secure the plug connector 104 to the header connector 102. Optionally, the lever 118 may include a slot that receives corresponding guide features 128 to control mating and unmating of the plug connector 104 to the header connector 102. For example, as the lever 118 is rotated closed, the housing 130 may be pulled down onto the header housing 120. Conversely, as the lever 118 is raised, the housing 130 may be pressed away from and unmated from the header housing 120. The high power circuit and the HVIL circuit of the power connector system 100 may be opened and closed as the plug connector 104 is unmated from and mated to the header connector 102.

Figure 3:
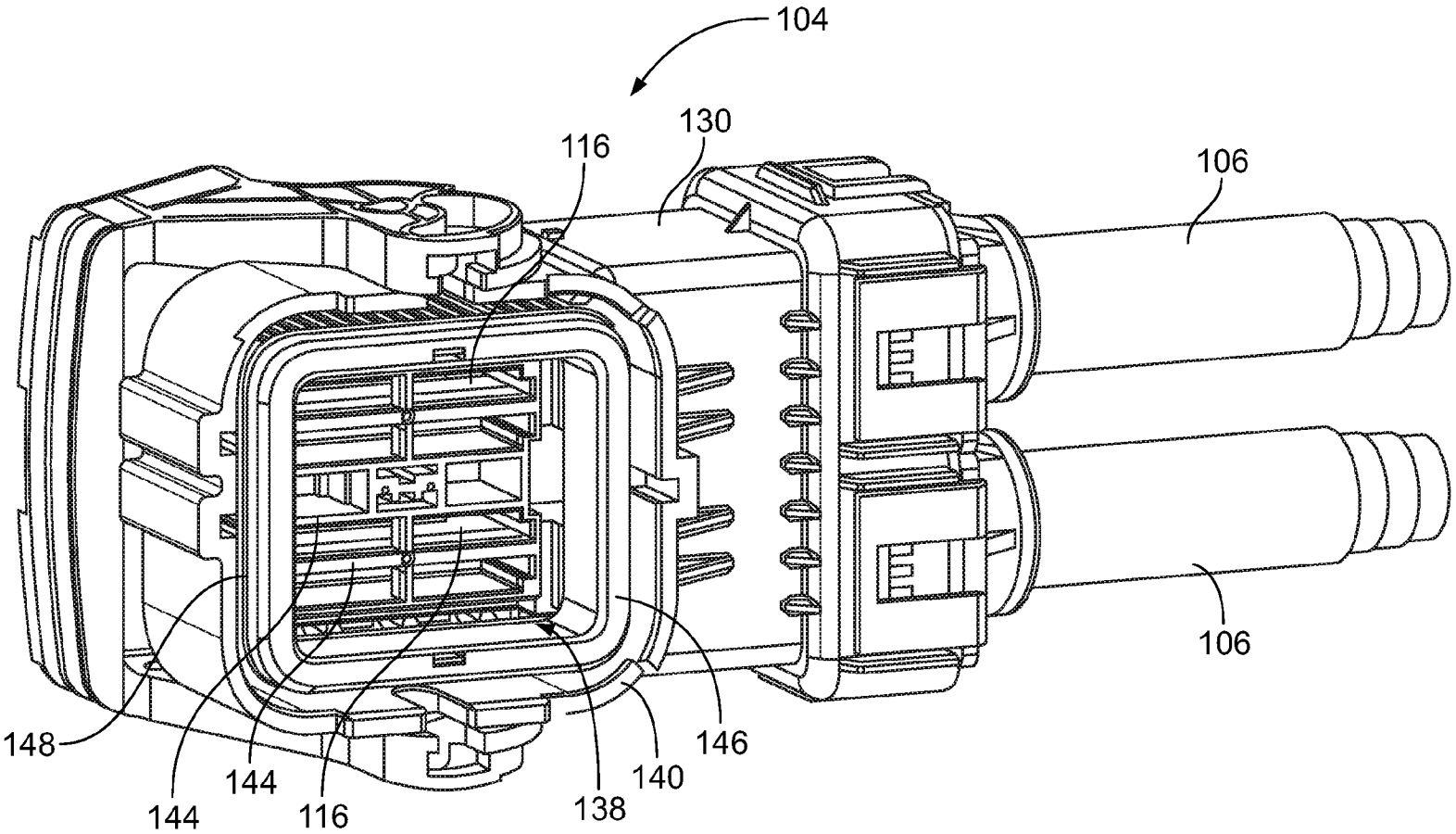
FIG. 3 is a bottom perspective view of the plug connector in accordance with an exemplary embodiment.

FIG. 3 is a bottom perspective view of the plug connector 104 in accordance with an exemplary embodiment. The plug housing 130 holds the plug terminals 116 in a plug chamber 138. The plug chamber 138 is open at a bottom 140 of the plug housing 130 to expose the plug terminals 116. Portions of the header connector 102 (shown in FIG. 2) may be received in the plug chamber 138 through the bottom 140. For example, the header terminals 114 (shown in FIG. 2) may be received in the plug chamber 138 for electrical connection with the plug terminals 116.

In an exemplary embodiment, the plug connector 104 includes cover or touch guards 144 such that the plug terminals 116 are touch safe. For example, the touch guards 144 may be bridges or beams spanning across the bottom of the plug terminals 116. The touch guards 144 are made from a dielectric material, such as plastic. The touch guards 144 are positioned relative to portions of the plug housing 130 such that gaps or spaces are small enough to be touch safe.

In an exemplary embodiment, the plug connector 104 includes a shield 146 to provide electrical shielding for the plug connector 104. Optionally, the shield 146 may be at least partially positioned in the plug chamber 138 such that the shield 146 surrounds the plug chamber 138 and/or the plug terminals 116. The shield 146 may be electrically connected to the electrical shielding of the power cables 106. The shield 146 may be configured to be electrically connected to the header connector 102. Optionally, the plug connector 104 may include a seal 148 in or around the plug chamber 138. The seal 148 may engage the header connector 102 to provide an environmental seal between the plug connector 104 and the header connector 102.

Figure 4:
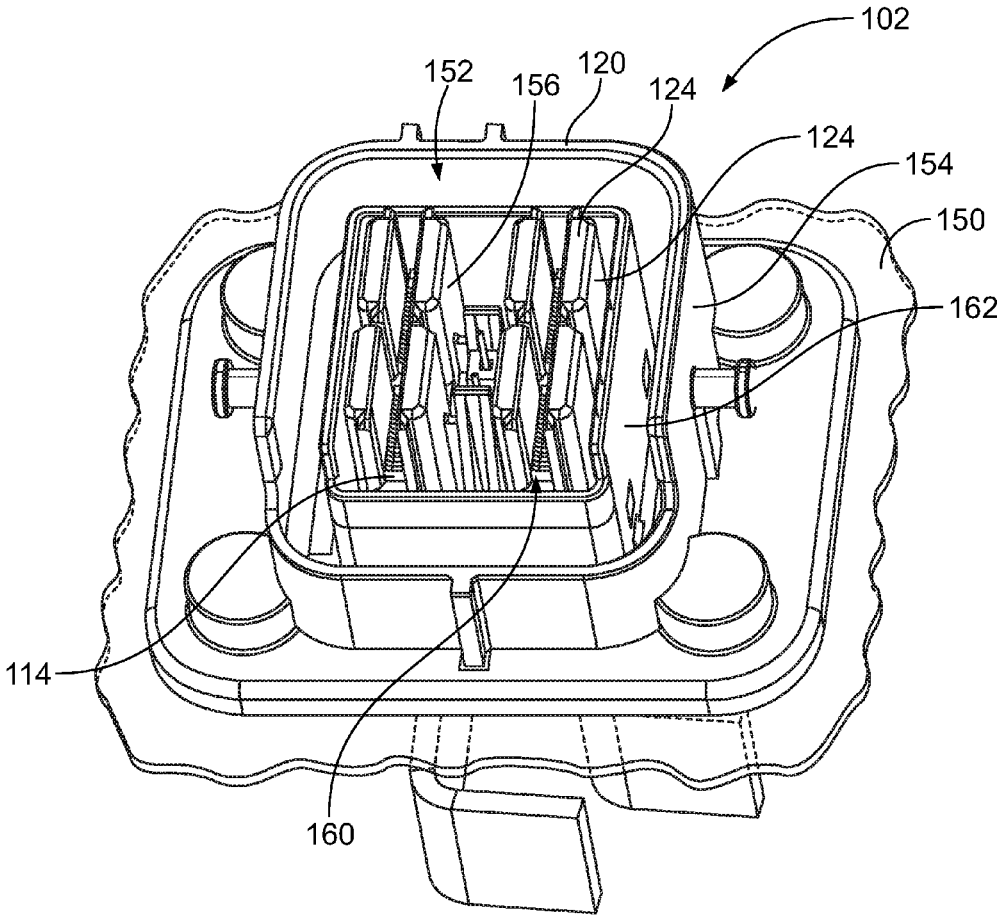
FIG. 4 is a top perspective view of the header connector in accordance with an exemplary embodiment.

FIG. 4 is a top perspective view of the header connector 102 in accordance with an exemplary embodiment. The header connector 102 is configured to be mounted to a chassis 150 or other supporting structure. Optionally, the header connector 102 may be electrically grounded to the chassis 150. The header housing 120 defines a header chamber 152 configured to receive a portion of the plug connector 104 (shown in FIG. 3). For example, the header chamber 152 may be defined by shroud walls 154 of the header housing 120.

The header terminals 114 are supported by the header housing 120. The header terminals 114 may be held by terminal support walls 156. The terminals support walls 156 may define the touch guards 124 to make the header connector 102 touch safe. For example, the terminal support walls 156 may be provided along sides and/or ends of the header terminals 114.

In an exemplary embodiment, two header terminals 114 are configured to mate to each plug terminal 116 (shown in FIG. 3). The header terminals 114 may define different circuits or may be part of common circuits. For example, the two header terminals 114 that mate to the same plug terminal 116 may be part of a common circuit, and the header terminals 114 mated to different plug terminals 116 may define different circuits. Optionally, providing multiple header terminals 114 increases the current carrying capability or capacity of the header connector 102. The header connector 102 includes four header terminals 114 in the illustrated embodiment, but may include fewer or more header terminals 114 in other embodiments.

In an exemplary embodiment, the header connector 102 includes a shield 162 held by the header housing 120. The shield 162 provides electrical shielding for the header terminals 114. The shield 162 is provided in the header chamber 152 and may extend to the bottom of the header connector 102 to electrically connect with the chassis 150. For example, the shield 162 may be grounded to the chassis 150.

Figure 5:
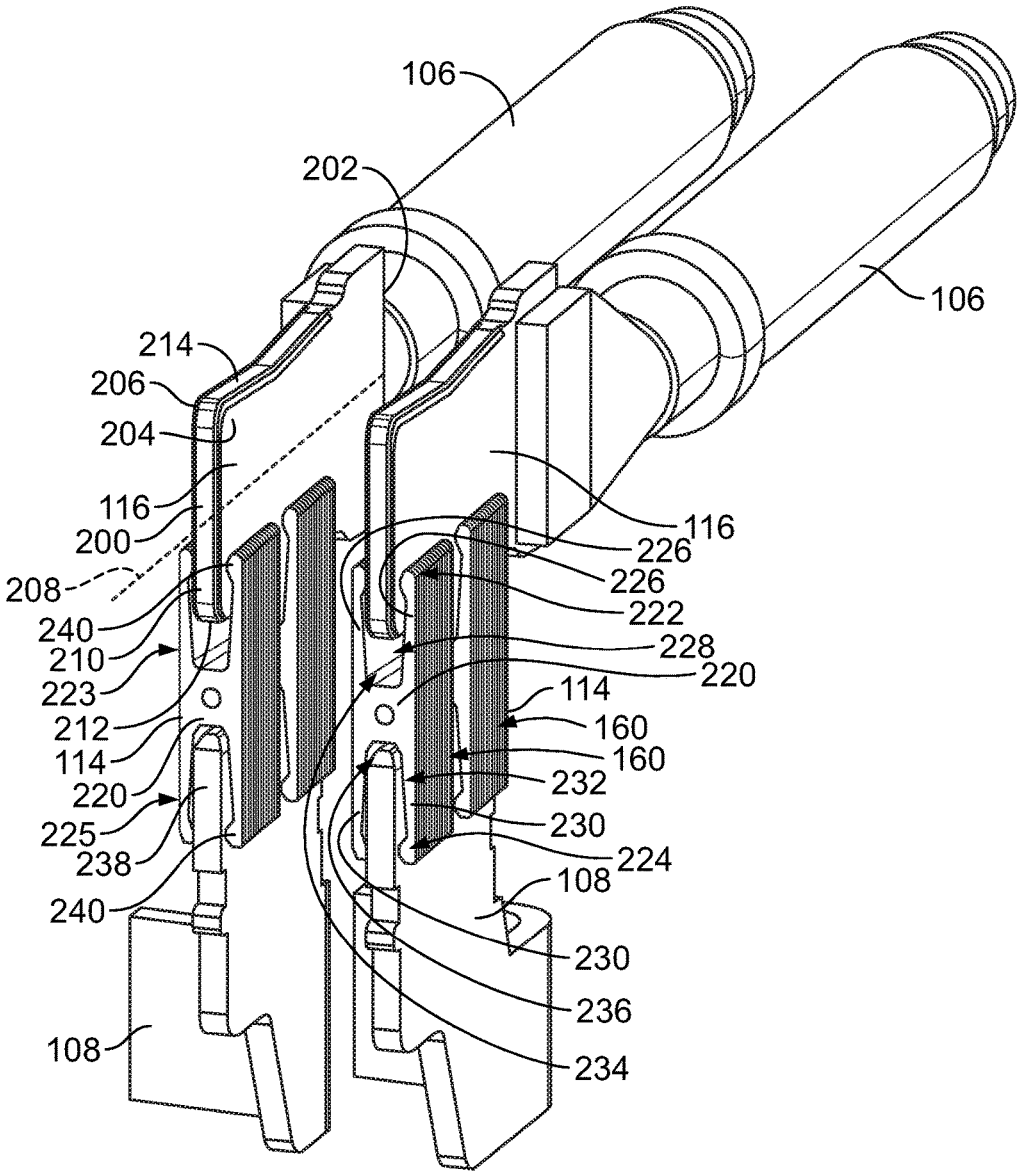
FIG. 5 is a perspective view of a portion of the power connector system showing plug terminals and header terminals.

FIG. 5 is a perspective view of a portion of the power connector system 100 with the header housing 120 and the plug housing 130 removed to illustrate the plug terminals 116 and the header terminals 114. The plug terminals 116 are terminated to the power cables 106. For example, the plug terminals 116 may be welded to the power cables 106. The plug terminal 116 may be terminated to the power cable 106 by other means in alternative embodiment, such as crimping. In the illustrated embodiment, the plug terminals 116 are tab terminals that include tab or blade sections. The plug terminals 116 are referred to hereinafter as tab terminals 116. Each tab terminal 116 is generally planar (at least along the tab or blade section) and extends between a mating end 200 and a cable end 202.

The tab terminal 116 includes first and second sides 204, 206 extending along a longitudinal axis 208 between a tip 210 of the tab terminal 116 and the cable end 202. The tab terminal 116 includes a leading edge 212 and a trailing edge 214 at the bottom and top, respectively, of the tab terminal 116. The leading edge 212 is the edge of the tab terminal 116 that is plugged into one or more of the header terminals 114.

The header terminals 114 are configured to be electrically connected to the tab terminals 116. In an exemplary embodiment, the header terminals 114 are also electrically connected to the power busses 108 of the header connector 102 (shown in FIG. 2). However, in alternative embodiments, the header terminals 114 may be integral with the power busses 108. In the illustrated embodiment, the header terminals 114 are double-ended fork terminals and may be referred to hereinafter as fork terminals 114.

Each of the header terminals 114 includes a series of contact members 160 stacked side by side. Each contact member 160 includes a main body 220 between a first mating end 222 and a second mating end 224. The contact members 160 each include a pair of spring beams 226 defining a socket 228 at the first mating end 222 and a pair of spring beams 230 defining a socket 232 at the second mating end 224. When the contact members 160 are stacked together to define the header terminal 114, the sockets 228 of the contact members 160 align within the header terminal 114 to define a tab socket 234 at the first mating end 222. The tab socket 234 at the first mating end 222 is configured to receive the leading edge 212 of the tab terminal 116. Similarly, the sockets 232 of the individual contact members 160 align within the header terminal 114 to define a bus bar socket 236 at the second mating end 224 that is configured to receive a mating end 238 of the corresponding power bus 108. In the illustrated embodiment, the spring beams 226 of the contact members 160 in each header terminal 114 define a fork contact 223 at the first mating end 222, and the spring beams 230 of the contact members 160 define a fork contact 225 at the second mating end 224.

The spring beams 226, 230 are deflectable to receive the tab terminal 116 and the power bus 108, respectively. When mated, the spring beams 226, 230 are spring biased against the tab terminal 116 and the power bus 108, respectively. The spring beams 226 are arranged on both sides of the socket 228 to engage the first and second sides 204, 206 of the tab terminal 116.

In an exemplary embodiment, each spring beam 226 defines a mating interface 240 at or near a distal end of the spring beam 226. The mating interfaces 240 may be defined by bumps or protrusions at the distal ends of the spring beams 226. In an exemplary embodiment, each fork contact 223, which is defined by multiple spring beams 226 stacked together, includes multiple points of contact with the tab terminal 116. For example, each mating interface 240 on a spring beam 226 in the stack defines a different point of contact with the tab terminal 116. Providing multiple contact members 160 in each header terminal 114 defines multiple points of contact between the tab terminal 116 and the header connector 102. Increasing the number of contact members 160 in each header terminal 114 and/or increasing the number of header terminals 114 increases the amount of current carrying capacity of the header connector 102.

The fork contact 225 at the second mating end 224 (for example, the power bus mating side) of each header terminal 114 may operate in the same or similar manner as the fork contact 223. For example, the fork contacts 223, 225 of a header terminal 114 may be identical, with the tab terminal 116 configured to plug into the tab socket 234 and the power bus 108 configured to plug into the bus bar socket 236. The header terminals 114 are easily manufactured and assembled. For example, the contact members 160 may be stamped and formed, and any number of the contact members 160 may be arranged together within each of the header terminals 114.

Figure 6:
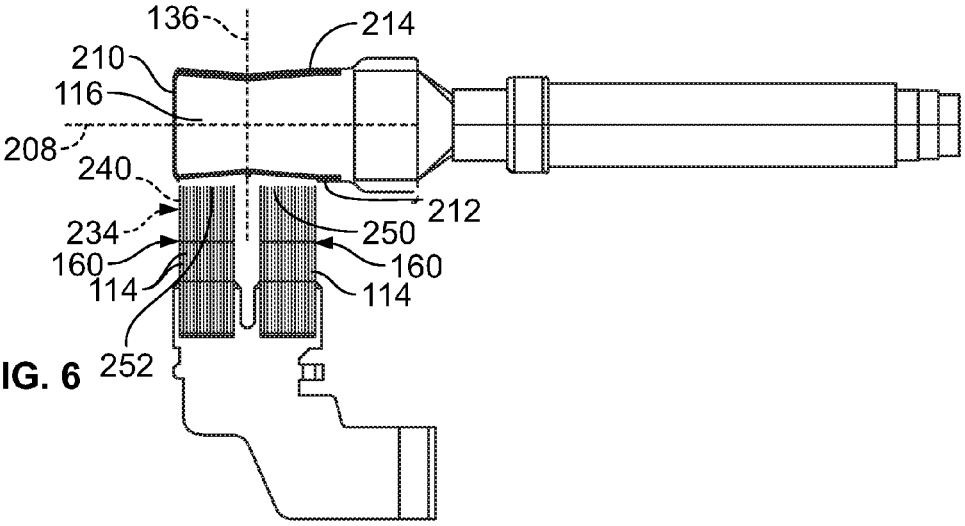
FIG. 6 is a side view of a portion of the power connector system showing the plug terminal poised for mating with the header terminals.

FIG. 6 is a side view of a portion of the power connector system 100 showing the plug terminal 116 poised for mating with two header terminals 114. The header housing 120 and the plug housing 130 are removed for clarity. In an exemplary embodiment, the tab terminal 116 is shaped to reduce mating forces with the header terminals 114 (and the contact members 160 thereof). For example, the leading edge 212 is angled non-orthogonal to provide sequenced mating with the contact members 160 of the header terminals 114. For example, in the illustrated embodiment, the leading edge 212 is inwardly tapered to provide a concave shape that may resemble a bow tie. For example, the leading edge 212 includes a first angled surface 250 and a second angled surface 252 at different angles. For example, the first angled surface 250 may have a positive slope while the second angled surface 252 may have a negative slope. The leading edge 212 may have other shapes in alternative embodiments. For example, rather than being inwardly tapered, the leading edge 212 may be outwardly tapered, such as with the angled surfaces being chevron shaped. In other various embodiments, the leading edge 212 may include more than two angled surfaces. Optionally, the trailing edge 214 may have an identical shape as the leading edge 212 such that either edge of the tab terminal 116 may be loaded into the tab socket 234 during mating. Optionally, rather than having the leading edge 212 along the side, the leading edge (for example, the portion of the tab terminal 116 plugged into the tab socket 234 may be at the tip 210.

In an exemplary embodiment, the leading edge 212 is angled relative to the longitudinal axis 208. For example, the leading edge 212 is non-parallel with respect to the longitudinal axis 208. In the illustrated embodiment, the first angled surface 250 is angled relative to the longitudinal axis 208 and the second angled surface 252 is angled relative to the longitudinal axis 208. The leading edge 212 is non-perpendicular with respect to the mating direction along the mating axis 136.

During mating, the contact members 160 of the header terminals 114 are configured to engage the tab terminal 116 at different times. For example, in the illustrated embodiment, two header terminals 114 are illustrated. One of the header terminals 114 is aligned with the first angled surface 250 and engages the tab terminal 116 at the first angled surface 250, whereas the second header terminal 114 is aligned with and engages the second angled surface 252. The contact members 160 of the header terminals 114 generally initially engage the tab terminal 116 at different times during the mating process. For example, because the first angled surface 250 is angled relative to the mating interfaces 240 of the contact members, each contact member 160 in the first header terminal 114 mates with the tab terminal 116 at a different time as the tab terminal 116 is plugged into the tab socket 234. Similarly, each contact member 160 in the second header terminal 114 engages the second angled surface 252 at a different time.

Optionally, the contact members 160 of the first header terminal 114 may engage the tab terminal 116 at the same times as corresponding contact members 160 of the second header terminal 114 engage the tab terminal 116. For example, the outer-most contact members 160 in each header terminal 114 may engage the tab terminal 116 simultaneously as the tab terminal 116 is mated to the header terminals 114, the inner-most contact members 160 of each header terminal 114 may engage simultaneously, and likewise therebetween. However, because the majority of the contact members 160 initially engage the tab terminal 116 at a different time, the mating forces are reduced. For example, each contact member 160 may have a peak mating force at a particular point during the mating process with the tab terminal 116. Because each of the contact members 160 within a single header terminal 114 engages the tab terminal 116 at a different time, the peak mating forces are offset over time, reducing the overall mating force between the tab terminal 116 and the header terminals 114. As used herein, the times that contact members 160 within the header terminals 114 engage the tab terminal 116 during the mating process refers to the times at which each contact member 160 makes initial contact with the tab terminal 116.

In an exemplary embodiment, the leading edge 212 has the concave shape with two oppositely angled surfaces 250, 252 to balance mating forces during mating. For example, when the tab terminal 116 is plugged into the header terminal 114, the first angled surface 250 may tend to force the tab terminal 116 to the right while the second angled surface 252 may tend to force the tab terminal 116 to the left. The mating forces are generally equal and opposite such that the tab terminal 116 is moved neither to the left nor to the right during mating. FIG. 6 illustrates the tab terminal 116 immediately prior to the tab terminal 116 being loaded into the header terminals 114. For example, the mating interfaces of the outer most contact members 160 of the header terminals 114 are immediately below the leading edge 212.

Figure 7A:
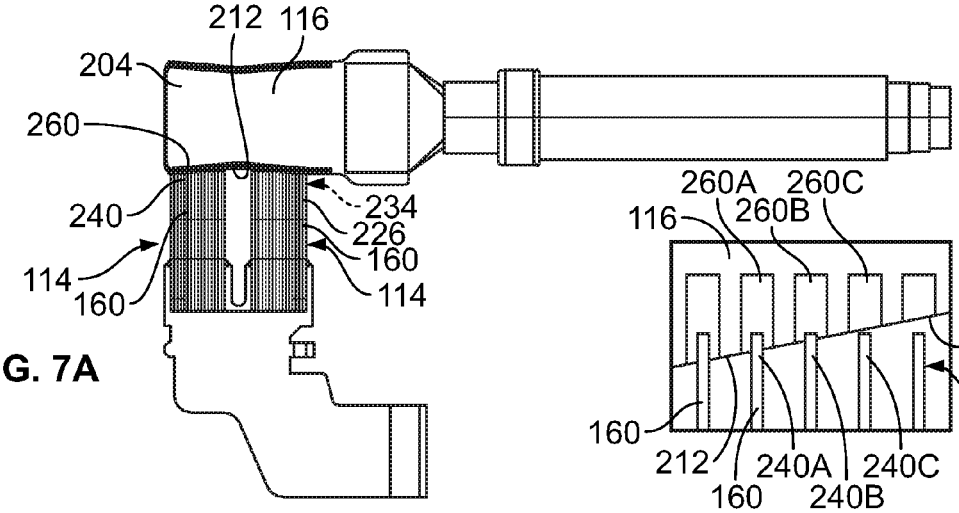
FIG. 7A illustrates the plug terminal partially mated with the header terminals.
Figure 7B:
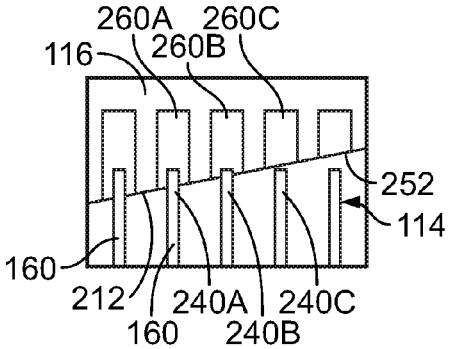
FIG. 7B illustrates a close-up view of the mating interface between the plug terminal and one of the header terminals along a first angled surface of the plug terminal.
Figure 8:
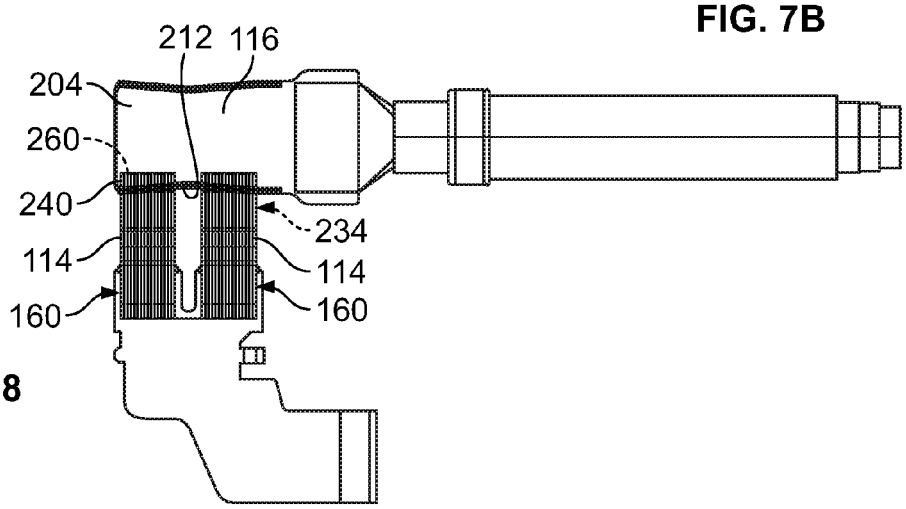
FIG. 8 illustrates the plug terminal fully mated with the header terminals.

FIG. 7A illustrates the tab terminal 116 partially mated with the header terminals 114. FIG. 7B illustrates a close-up view of the mating interface between the tab terminal 116 and one of the header terminals 114 along the first angled surface 252 of the tab terminal 116. FIG. 8 illustrates the tab terminal 116 fully mated with the header terminals 114. For example, as shown in FIGS. 7A and 7B, only the mating interfaces 240 of some outer contact members 160 of the header terminals 114 engage the leading edge 212. The mating interfaces 240 of some inner contact members 160 of the header terminals 114 are below the leading edge 212 (e.g., and not connected to the tab terminal 116). In contrast, FIG. 8 illustrates the tab terminal 116 sufficiently loaded into the tab socket 234 of each of the header terminals 114 such that the mating interface 240 of each of the contact members 160 engages the tab terminal 116.

The leading edge 212 of the tab terminal 116 defines multiple mating interfaces 260. Each mating interface 260 is aligned directly above a mating interface 240 of the corresponding contact member 160 of the header terminals 114. As the tab terminal 116 is pressed downward into the tab socket 234, the mating interfaces 260, 240 are successively and sequentially mated. For example, at the instant when one of the mating interfaces 260 engages the corresponding mating interface 240, the immediately adjacent mating interface 260 to one side has already previously been mated while the mating interface 260 to the opposite side remains unmated. As such, only one of the mating interfaces 260 (along the first angled surface 252) is mated at a time. For example, FIG. 7B illustrates mating interfaces 240A, 240B, 240C of adjacent contact members 160 of one header terminal 114 aligned with corresponding mating interfaces 260A, 260B, 260C of the tab terminal 116. The second mating interfaces 240B, 260B are in the middle of the first and third mating interfaces 240A, 240C, 260A, 260C. FIG. 7B illustrates the second mating interfaces 240B, 260B at initial mating. The first mating interfaces 240A, 260A have been previously mated such that the spring beams 226 of the contact member 160 including the first mating interface 240A have advanced a distance along the sides 204, 206 (shown in FIG. 5) of the tab terminal 116. The third mating interfaces 240C, 260C are not yet mated but are the next mating interfaces to mate as the tab terminal 116 is advanced downward. The third mating interface 240C is spaced a slight distance below the third mating interface 260C such that such contact member 160 including the third mating interface 240C is not directly electrically connected to the tab terminal 116.

Figure 9:
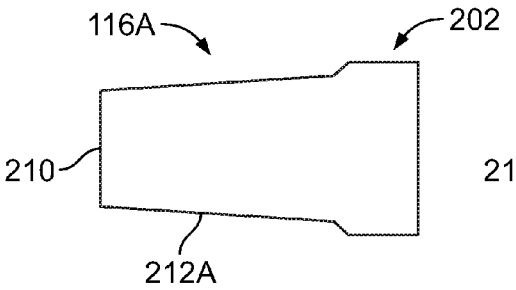
FIG. 9 is a side view of the plug terminal in accordance with an exemplary embodiment.
Figure 10:
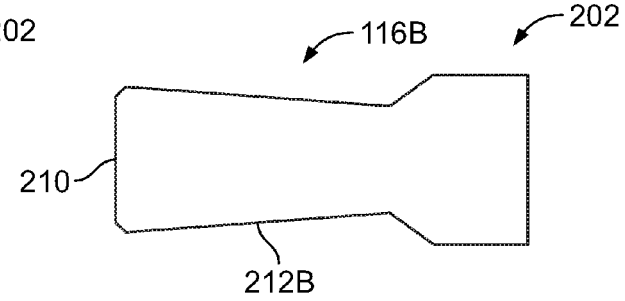
FIG. 10 is a side view of the plug terminal in accordance with an exemplary embodiment.

FIG. 9 is a side view of an alternative tab terminal 116A. FIG. 10 is a side view of another alternative tab terminal 116B. The tab terminals 116A, 116B have different shapes than the tab terminal 116 (shown in FIG. 6). For example, the leading edges 212A, 212B may be shaped differently than the leading edge 212 (shown in FIG. 6). The leading edges 212A, 212B are angled non-parallel relative to the longitudinal axis. The leading edges 212A, 212B are angled non-perpendicular to the mating direction. The tab terminal 116A has a narrowing taper while the tab terminal 116B has a widening taper. For example, the width of the tab terminal 116A at the tip 210 is narrower then near the cable end 202, whereas the width of the tab terminal 116B at the tip 210 is wider then near the cable end 202. Other shaped tab terminals may be provided in alternative embodiments.

Figure 11:
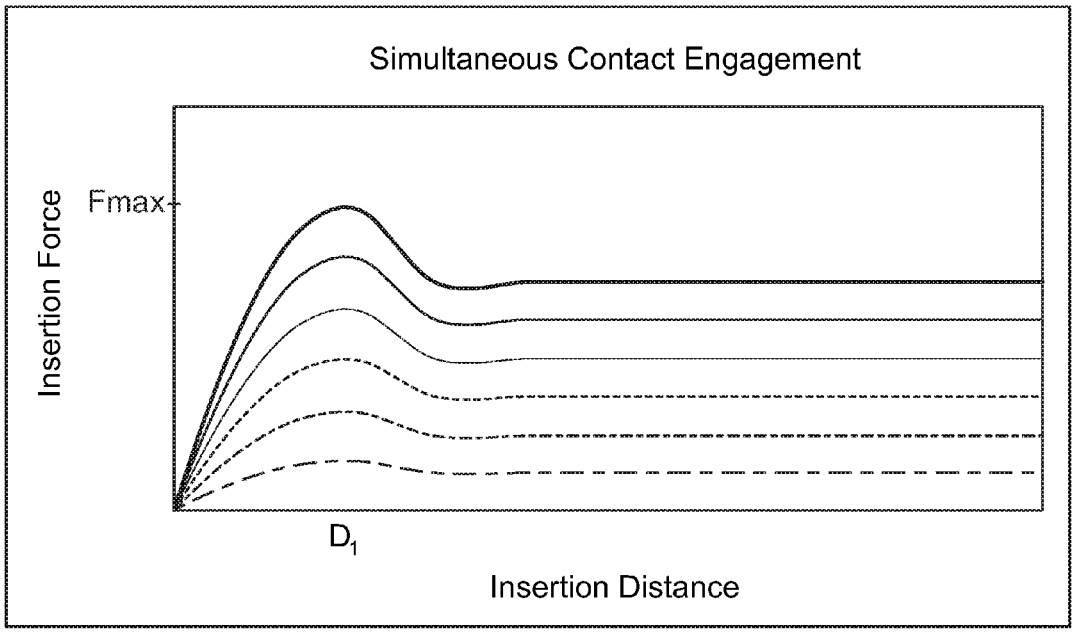
FIG. 11 is a graph showing insertion forces between a plug terminal and contact members of a header terminal having simultaneous contact engagement.
Figure 12:
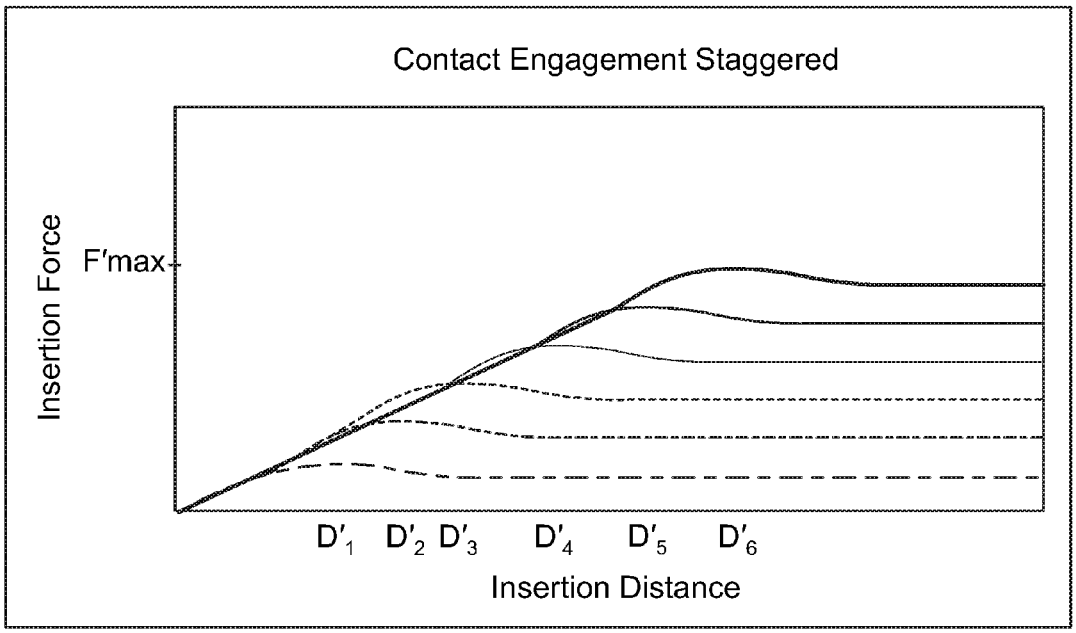
FIG. 12 is a graph showing insertion forces between a plug terminal and contact members of a header terminal having staggered contact engagement.

FIG. 11 is a graph showing insertion forces between a tab terminal and six contact points of a header terminal, such as provided by six contact members, having simultaneous contact engagement (where all mating interfaces engage at the same time, such as when a flat or parallel leading edge is provided). FIG. 12 is a graph showing insertion forces between a tab terminal and six contact points having staggered contact engagement (where the mating interfaces engage at different times, such as with the tab terminal 116 having the angled leading edge 212 as shown in FIG. 6).

During mating, for each contact member in the header terminal, the contact engagement between the tab terminal and such contact member has an initially increasing insertion force as the leading edge is first loaded into the tab socket of the header terminal. The insertion force is increased to a peak insertion force, after which the insertion force slightly decreases and may level out. The insertion forces are defined by frictional forces between the contact members and the tab terminal. For example, as the spring beams of the contact members slide or wipe along the tab terminal, the header terminal experiences an insertion force. Such friction forces are affected by the spring forces or clamping forces of the spring beams on the tab terminal, which may change as the spring beams are deflected outward by loading of the tab terminal into the tab socket leading to the peaked insertion force curve.

When multiple contact members in a header terminal are mated with the tab terminal, the insertion forces have a cumulative effect. When the contact members are simultaneously mated with the tab terminal, the peak insertion forces occur simultaneously at insertion distance D1 leading to a high overall insertion force Fmax, as shown in FIG. 11. However, when the mating between the contact members and the tab terminal is staggered, the insertion forces are also staggered, leading to a reduced overall insertion force. For example, as shown in FIG. 12, because each of the peaks are offset and occur at different insertion distances D'1, D'2, D'3, D'4, D'5, D'6, the overall insertion force F'max is reduced. However, the insertion force increases over a greater insertion distance (for example, F'max is located at D'6 as opposed to Fmax being located at D1).

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A plug connector comprising:

a housing having a mating end and a cable end, the mating end being configured to be mated with a header connector in a mating direction; and a tab terminal held in the housing at the mating end, the tab terminal having a leading edge configured to be mated with a header terminal having opposing rows of plural points of contact of the header connector when the plug connector is mated to the header connector, the leading edge being tapered such that the tab terminal sequentially mates with the opposing rows of plural points of contacts of the header terminal along the leading edge during mating.

2. The plug connector of claim 1, wherein the leading edge is angled non-orthogonal relative to the mating direction.

3. The plug connector of claim 1, wherein the leading edge is angled relative to mating interfaces of the header terminal.

4. The plug connector of claim 1, wherein the tab terminal extends along a longitudinal axis to a tip, the leading edge being angled non-parallel to the longitudinal axis.

5. The plug connector of claim 1, wherein the tab terminal has a plurality of mating interfaces along the leading edge, adjacent mating interfaces of the tab terminal mating with corresponding mating interfaces of the header terminal at different times.

6. The plug connector of claim 1, wherein the sequential mating with the header terminal reduces the tab terminal engagement force with the header terminal.

7. The plug connector of claim 1, wherein the header terminal includes multiple contact members arranged in a stacked arrangement, the leading edge of the tab terminal engaging different contact members of the header terminal sequentially during mating.

8. The plug connector of claim 1, wherein the tab terminal has first and second sides that are both configured to engage the header terminal.

9. The plug connector of claim 1, wherein the tab terminal includes a trailing edge opposite the leading edge, the trailing edge having the same shape as the leading edge.

10. The plug connector of claim 1, wherein the leading edge is inwardly tapered.

11. The plug connector of claim 1, wherein the leading edge includes a first angled portion and a second angled portion at different angles.

12. A power connector system comprising:

a header connector having a header housing holding a plurality of contact members, each contact member having a fork contact at a mating end thereof, each fork contact having a pair of spring beams defining a socket, the contact members being arranged side-by-side in a stacked arrangement to define a header terminal such that the sockets of the contact members are aligned to define a tab socket of the header terminal, the stacked arrangement of contact members having the contact members arranged in opposing rows of points of contact; and a plug connector having a plug housing holding a tab terminal, the plug housing having a mating end and a cable end with a power cable extending from the cable end, the mating end being mated with the header connector in a mating direction during mating, the tab terminal having first and second sides, the tab terminal having a cable end terminated to the power cable, the tab terminal having a leading edge received within the tab socket of the header terminal and engaging the fork contacts of the contact members of the header terminal when the plug connector is mated to the header connector, the leading edge being tapered such that the tab terminal sequentially mates with the opposing rows of points of contacts defined by the contact members of the header terminal along the leading edge during mating.

13. The power connector system of claim 12, wherein the leading edge of the tab terminal is angled non-orthogonal relative to the mating direction.

14. The power connector system of claim 12, wherein the leading edge of the tab terminal is angled relative to mating interfaces on the spring beams of the contact members.

15. The power connector system of claim 12, wherein the spring beams each have a mating interface, the mating interfaces of the spring beams being aligned along a spring beam plane, the leading edge of the tab terminal being angled relative to the spring beam plane.

16. The power connector system of claim 12, wherein the tab terminal extends along a longitudinal axis to a tip, the leading edge being angled non-parallel to the longitudinal axis.

17. The power connector system of claim 12, wherein the tab terminal has a plurality of tab mating interfaces along the leading edge, the spring beams having spring beam mating interfaces, wherein adjacent tab mating interfaces mate with corresponding spring beam mating interfaces at different times during mating.

18. The power connector system of claim 12, wherein the first and second sides of the tab terminal are configured to engage the header terminals.

19. The power connector system of claim 12, wherein the leading edge of the tab terminal is inwardly tapered.

20. The power connector system of claim 12, wherein the leading edge of the tab terminal includes a first angled portion and a second angled portion at different angles.

* * * * *